US005080054A

United States Patent [19]

Nakamura

[11] Patent Number: 5,080,054

[45] Date of Patent: Jan. 14, 1992

[54] ROCKER ARM ARRANGEMENT FOR VARIABLE TIMING VALVE TRAIN

[75] Inventor: Makoto Nakamura, Kanagawa, Japan

[73] Assignee: Nissan Motor Co., Ltd., Japan

[21] Appl. No.: 662,135

[22] Filed: Feb. 28, 1991

[30] Foreign Application Priority Data

Mar. 7, 1990 [JP] Japan ..... 2-55827

[51] Int. Cl.[5] ..... F01L 1/34

[52] U.S. Cl. ..... 123/90.16; 123/90.39

[58] Field of Search ..... 123/90.15, 90.16, 90.17, 123/90.39, 90.4

[56] References Cited

U.S. PATENT DOCUMENTS

| | | | |
|---|---|---|---|
| 4,612,884 | 9/1986 | Aijki et al. | 123/90.16 |
| 4,848,284 | 7/1989 | Konno | 123/90.16 |
| 4,854,273 | 8/1989 | Uesugi et al. | 123/90.16 |

*Primary Examiner*—E. Rollins Cross
*Assistant Examiner*—Weilun Lo
*Attorney, Agent, or Firm*—Lowe, Price, LeBlanc & Becker

[57] ABSTRACT

A main rocker arm which is pivotally mounted on a rocker shaft has a sub-rocker arm pivotally mounted thereon. The main rocker arm is arranged to open and close at least one poppet valve. A hydraulic lash adjuster or adjusters are arranged at the free end of the main rocker arm to reduce valve clearance to zero. The sub-rocker arm can be selectively locked to the main one by way of hydraulically operated plunger arrangement. The main rocker arm is provided with a roller type cam follower which follows a low speed cam. The sub-rocker arm is provided with a follower which engages a high speed cam. The low speed cam follower is arranged to project above the high speed one when the two rocker arms are interlocked so that the low speed cam follower engages the base circle of the low speed cam and a clearance is developed between the high speed cam follower and the base circle of the high speed cam. This eliminates the need for sudden changes in lash adjuster length when the valve train operation switches between high and low speed operation.

10 Claims, 3 Drawing Sheets

ROCKER ARM ARRANGEMENT FOR VARIABLE TIMING VALVE TRAIN

BACKGROUND OF THE INVENTION

1. Field of the Invention

The present invention relates generally to an engine valve train and more specifically to a variable valve timing arrangement which permits the lift and/or timing of the valves to be selectively varied.

2. Description of the Prior Art

JP-A-63-167016 and JP-A-63-57805 disclose rocker arm arrangements which include a main rocker arm which cooperates with a low speed cam and a sub-rocker arm which cooperates with a high speed cam. The two rocker arms are pivotally mounted on a common rocker arm shaft.

A hydraulically operated connection or interlocking device which enables the main and sub-rocker arms to be selectively locked together, comprises a set of plunger bores which are formed in the rocker arms in a manner to be parallel with and at a predetermined distance from, the axis of the shaft about which the arms are commonly pivotal. By applying a hydraulic pressure to the end or ends of the plungers reciprocally disposed in the bores, the plungers can be induced to move axially and induce the situation wherein two of the plungers will partially enter an adjacent bore and lock the two arms together.

However, these type of arrangement have tended to have suffered from the drawback that as set screws are used to set the valve clearances, depending on engine temperature the amount of tappet noise tends to be excessive. In order to overcome this problem it has been proposed to use hydraulic hydraulic lash adjusters in order to reduce the valve clearance to zero under all modes if engine operation. These lash adjuster have been mounted in the main rocker arm. When the main rocker arm is driven by engagement between the low speed cam and low speed cam follower, the lash adjusters each reduce the clearance between the upper end of the valve stem member and the member of the rocker arm which operatively engages the same.

However, when the mode of engine operation switches to a high speed one and the sub-rocker arm is subsequently locked with the main rocker arm in a manner wherein the main rocker arm is driven by the engagement between the high speed cam and the high speed cam follower (on the sub-rocker arm), due to the inevitable dimensional deviations which occur during manufacture of the valve train components, it sometimes happens that, under interlocked conditions, the high speed cam follower projects slightly above the low speed one (viz., further toward the cam shaft). Thus, as the base circles of the high and low speed cams are ground to an essentially identical diameter, immediately after a change from one speed mode to another, it can occur that the lash adjuster has adjusted its length (elongated) to suit the lift characteristics provided by the "lower" of the two cam followers and is currently too long for the cam follower currently in use. As it takes a finite time for the lash adjuster to adjust its length (i.e. reduce to the appropriate length), there tends to be a period when the valve which is being lifted via contact with the overly elongated lash adjuster, tend to be held slightly open and cannot assume a fully closed condition.

SUMMARY OF THE INVENTION

It is an object of the present invention to provide a variable valve timing type rocker arm arrangement which eliminates the possibility that a lash adjuster will elongate or otherwise adjust itself to a condition which induces the above mentioned drawback.

In brief, the above object is achieved by an arrangement wherein: a main rocker arm is pivotally mounted on a rocker shaft and has a sub-rocker arm pivotally mounted thereon; the main rocker arm is arranged to open and close at least one poppet valve; a hydraulic lash adjuster or adjusters are arranged at the free end of the main rocker arm to reduce valve clearance to zero; the sub-rocker arm can be selectively locked to the main one by way of hydraulically operated plunger arrangement; the main rocker arm is provided with cam follower which follows a low speed cam; the sub-rocker arm is provided with a follower which engages a high speed cam; and wherein the low speed cam follower is arranged to project above the high speed one when the two rocker arms are interlocked so that the low speed cam follower engages the base circle of the low speed cam and a clearance is developed between the high speed cam follower and the base circle of the high speed cam.

More specifically, a first aspect of the invention comes in an internal combustion engine which features: a first rocker arm pivotally mounted on the cylinder head; a second rocker arm pivotally mounted on the first rocker arm; hydraulically operated engagement means for selectively connecting the first and second rocker arms in a manner wherein relative movement therebetween is prevented; a first cam follower on the first rocker arm, the first cam follower being arranged to operatively engage a first cam which has a base circle portion and a profile portion, the profile portion being suited for low speed engine operation; a second cam follower on the second rocker arm, the second cam follower being arranged to operatively engage a second cam which has a base circle portion and a profile portion which is suited for high speed engine operation; and wherein the first cam follower and the base circle portion of the first cam are so constructed and arranged that when the hydraulic locking means connects the first and second rocker arms in a manner which prevents relative movement therebetween, a predetermined clearance is established between the base circle portion of the second cam and the second cam follower while the first cam follower is engagement with the base circle portion of the first cam.

A second aspect of the present invention comes in a gear train for an internal combustion engine which gear train features: a cam shaft operatively mounted on a cylinder head; a first rocker arm pivotally mounted on the cylinder head; a second rocker arm pivotally mounted on the first rocker arm; hydraulically operated engagement means for selectively connecting the first and second rocker arms in a manner wherein relative movement therebetween is prevented; a first cam follower on the first rocker arm, the first cam follower being arranged to operatively engage a first cam which has a base circle portion and a profile portion, the profile portion being suited for low speed engine operation; a second cam follower on the second rocker arm, the second cam follower being arranged to operatively engage a second cam which has a base circle portion and a profile portion which is suited for high speed engine operation; and wherein the first cam follower is arranged to project further toward the cam shaft than the second cam follower when the hydraulic locking means connects the first and second rocker arms in a manner which prevents relative movement therebetween.

DETAILED DESCRIPTION OF THE PREFERRED EMBODIMENTS

Figure 1:
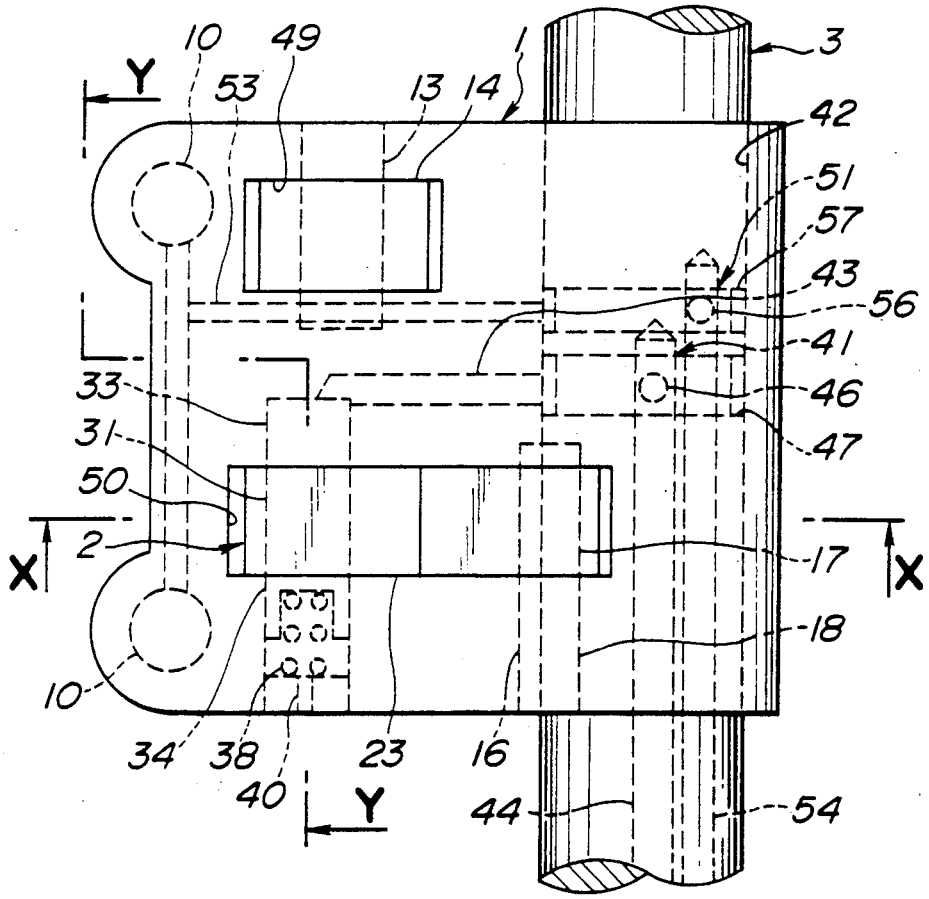
FIG. 1 is a plan view partially in section showing the construction which characterizes a first embodiment of the present invention.

FIGS. 1-5 show details of a first embodiment of the present invention. This embodiment takes the form of a rocker arm which is arranged to synchronously open and close two poppet valve 9. These valves 9 may be either inlet or exhaust valves.

A main rocker arm 1 is arranged so that one end there of engages both of the valves while the other is pivotally supported on the cylinder head by way of main rocker shaft 3. The ends of the main rocker arm which engage the valves are provided with hydraulic lash adjusters 10. A roller 14 is rotatably mounted on the main rocker arm 1 by way of needle bearings 12 and a support shaft 13. This roller 14 is arranged to act as a follower which engages a low speed cam 21 (viz., a cam which is configured for low speed engine operation).

A will be appreciated from the plan view of FIG. 1, the main rocker arm 1 has an essentially rectangular shape. A sub-rocker arm 2 is pivotally supported on the main rocker arm 1 by way of a sub-rocker arm shaft 16. The shaft 16 is received in a bore 17 formed in the sub-rocker arm 2 and a coaxial bore 18 formed in the main rocker arm 1.

The sub-rocker arm 2 does not directly engage the valves 9 and is formed with a convexly shaped cam follower portion 23 which is arranged to engage a high speed cam 22.

A lost motion spring 25 is received in a blind bore or recess 26 formed in the main rocker arm 1. In this embodiment the lost motion spring 25 is a coil spring. The lower end of the spring engages the blind end wall of the bore 26 while a retainer 27, which is reciprocatively disposed in the upper end of the bore 26, encloses the upper end of the same. A follower 28 is formed on the underside of the sub-rocker arm 2 and arranged to engage the top of the retainer 27.

Figure 3:
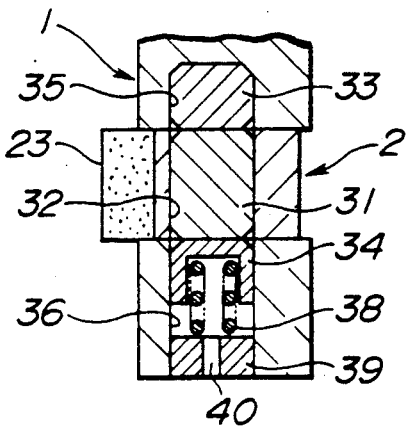
FIGS. 3 and 4 are views taken along section line Y—Y of FIG. 1 showing the sub-rocker arm in released and locked states, respectively.
Figure 4:
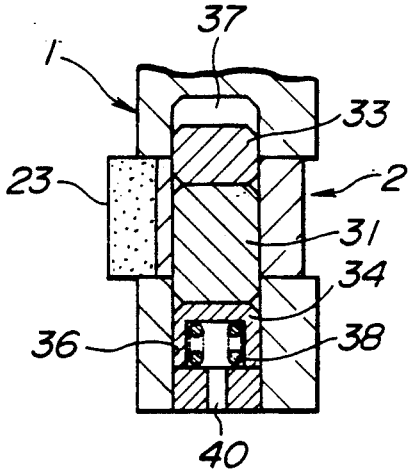

An interlocking arrangement for selectively interconnecting the main and sub-rocker arms 1, 2 comprises a structure of the nature shown in FIGS. 3 and 4. As shown, this structure includes a plunger 31 which is reciprocatively received in a though bore 32 formed in the sub-rocker arm 2, and plungers 33, 34 which are respectively received in bores 35, 36 formed in the main rocker arm 1. The plunger 33 defines a variable volume hydraulic fluid chamber 37 in the bore 35. On the other hand, a return spring 38 is disposed in the bore 36 between the plunger 34 and a plug 39 in which an air vent bore 40 is formed.

When the pressure prevailing in the hydraulic chamber 37 is below a level at which the bias of the return spring 38 is overcome, the plungers 31, 33 and 34 assume the positions shown in FIG. 3. As will be appreciated, the plunger 33 and the bore are dimensioned so that when the hydraulic pressure is below the above mentioned level, the end face which engages one of the end faces of the plunger 31, lies flush with the wall surface of the main rocker arm 1 in which the bore 33 is formed. The plunger 31 is dimensioned so that under these conditions its end faces lie flush with the side walls of the sub-rocker arm 2. This of course maintains the plunger 34 in a state wherein its end face lies flush with the wall surface of the main rocker arm in which the bore 36 is formed.

Under these conditions the sub-rocker arm 2 is rendered pivotal with respect to the main rocker arm 1 and thus can be driven down against the bias of the lost motion spring 25 under the influence of the high speed cam 22 engaging the cam follower 23.

On the other hand, when hydraulic pressure is supplied into the hydraulic chamber 37 and produces a bias which overcomes the force of the return spring 38, the plungers 31, 33 and 34 move to the positions illustrated in FIG. 4. This shifting of the plungers locks the two rocker arms together. In this state the movement of the main rocker arm 1 is determined by the engagement between the high speed cam 22 and the follower 23 formed on the sub-rocker arm.

A first hydraulic passage structure generally denoted by the numeral 41 in FIG. 1, provides fluid communication between the hydraulic chamber 37 and a non-illustrated control source. As shown, this passage structure comprises: a passage 43 formed in the main rocker arm which leads from one end of the bore in which the hydraulic chamber 37 is defined to a relatively large diameter bore 42 in which the rocker shaft 3 is received; an axial bore which defines an oil gallery 44 in the rocker shaft 3; an annular recess formed in the outer periphery of the rocker shaft 3; and a radial bore 46 which provides fluid communication between the oil gallery 44 and the recess 47. The passage 43 communicates with the recess 47.

A second passage structure generally denoted by the numberal 51 in FIG. 1 comprises: a passage 53 which is formed in the main rocker arm and which fluidly communicates the hydraulic lash adjusters 10 with the bore 42; a second oil gallery 54 which is constantly supplied hydraulic fluid under pressure from a non-illustrated engine driven oil pump; a radial bore 56 which leads from the oil gallery 54, and an annular recess 57 which is formed in the outer periphery of the rocker shaft 3 and into which the passage 53 and the radial bore 56 open.

The above mentioned control source comprises a switching valve (not shown) which is fluidly interposed between the chamber 37 and an oil pump. The valve is controlled by a control unit which receives data inputs indicative of engine speed, coolant temperature, lubricant oil temperature, supercharge pressure, engine throttle valve position, etc. This control unit determines when it is necessary to switch between high and low cam lifting.

The low and high speed cams 21, 22 are both formed integrally on a cam shaft and have profiles which are designed to produce the appropriate amount of lift and timing for low and high engine speed operation, respectively. Viz., the amount of lift and/or the length of time the valve is opened by the high speed cam 22 is greater than that induced the low speed one. The base circles 21*b*, 22*b* of the two cams are ground so as to have essentially identical diameters.

Figure 2:
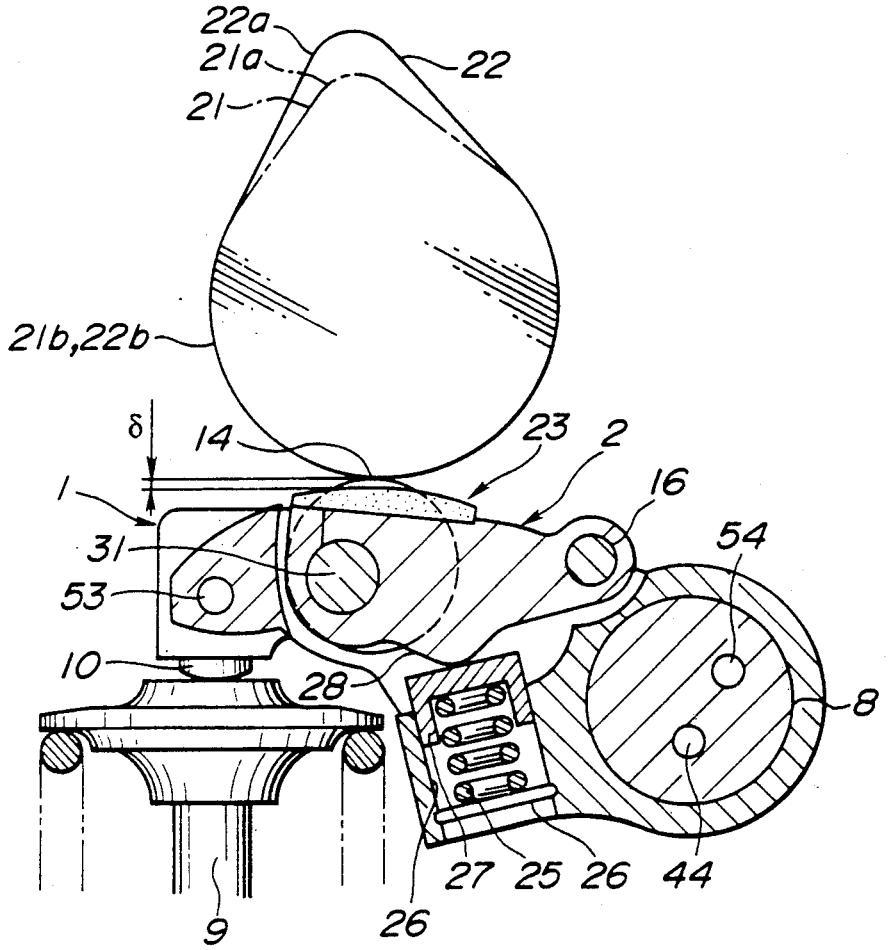
FIG. 2 is a side sectional view as taken along section line X—X of FIG. 1.

In order to solve the problem encountered with the prior art the roller 14 which acts as the low speed cam follower, either has a diameter or is rotatably supported in a manner wherein, as shown in FIG. 2 it projects above the high speed cam follower by a predetermined amount ∂ when the sub-rocker arm 2 is locked to the main rocker arm 1. In this manner, during both high and lower speed operations the roller 14 engages the base circle of the lower speed cam and during high speed operation a predetermined clearance ∂ develops between the base circle 22*b* of the high speed cam and the high speed cam follower 23.

As will be appreciated, as roller 14 is used during the non-lift stages of both high and low engine speed modes of engine operation, the need for the length of the lash adjusters 10 to vary in response to changes of mode is eliminated.

It will be noted that the magnitude of ∂ is exaggerated in FIG. 2 for the sake of illustrative clarity. In actual fact, the clearance ∂ is minute and selected based on the expected dimensional differences which are apt to be produced during the manufacture of the valve train components. In order to facilitate the interlocking of the main and sub rocker arms 1, 2 the shoulders of the plungers 31, 33 and 34 are chamfered in a manner which provides tapered portions. Viz., in the absence of these tapers it would be necessary to wait until both of the cam followers were in contact with the respective base circles at which time the bores in which the above mentioned plungers would align sufficiently to permit the interlocking action to take place. The tapers are of course designed to allow for the amount of misalignment which is apt to occur between the bores of the interlocking device due to the provision of the clearance ∂. Once the plungers have assume the positions illustrated in FIG. 4 the clearance which characterizes the present invention is securely maintained.

Figure 5:
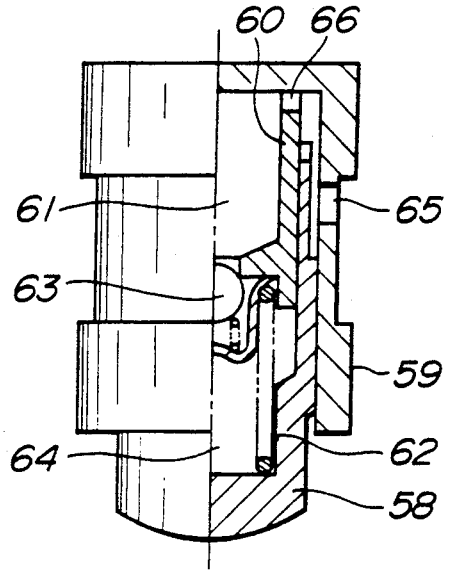
FIG. 5 is an elevation (half in section) which shows constructional details of the hydraulic lash adjusters used in the FIG. 1 arrangement.

FIG. 5 shows details of the lash adjusters used in the first embodiment. Each adjuster includes an outer plunger 58 which has a domed end adapted to engage the top of the valve stem. The outer plunger is reciprocatively received in body 59 which further houses an inner plunger 60. The body is of course immovably amounted in a suitable bore formed in the rocker arm. A retainer spring 62 is disposed within the outer plunger 58 and arranged to bias the inner and outer plungers 60, 58 apart and to bias the outer plunger down into contact with the top of the valve stem.

A reservoir chamber 61 is defined within the inner plunger 60. This chamber communicates by way of a check ball 63 with a high pressure chamber 64 defined within the outer plunger 58. The body 59 is formed with a port 65 communicates with the passage 51 formed in the main rocker arm. The inner plunger 60 is formed with a transfer opening via which the hydraulic fluid which is introduced into the body 59 via the port 65, can enter the reservoir chamber 61. During non lift modes of operation hydraulic fluid is transferred via the check ball 63 into the high pressure chamber 64.

When the valve 9 is moved downwardly against the bias of the valve spring 7, the resulting pressure which develops in the high pressure chamber 64 moves the check ball 63 to a position wherein it cuts off communication between the reservoir and high pressure chambers 61, 64. As a result, as the hydraulic fluid which is trapped in the high pressure chamber 64 can leak out only very slowly, the oil contained in the high pressure chamber acts as a quasi solid body during valve lift and prevents relatively movement between the inner and outer plungers 60, 58. On the other hand, during non-lift periods the check ball 63 moves to a position wherein communication between the reservoir and high pressure chambers 61, 64 is established and at the same time, the return spring 62 moves the domed end of the outer plunger 58 into contact with the top of the valve stem. Hydraulic fluid from the reservoir chamber 61 can be freely introduced into the high pressure chamber 64 at this time and thus maintain the same completely full at all times. This of course maintains the valve clearance at zero. As a result, tappet noise is greatly reduced.

OPERATION

During low speed engine operation, the pressure in the hydraulic chamber 37 is reduced to a level whereat the plungers 31, 33 and 34 assume the positions illustrated in FIG. 3. As a result, the sub-rocker arm 3 is left unlocked from the main one 1 and is permitted to pivot relative to the main rocker arm 1 against the bias of the lost motion spring 25. The movement of the main rocker arm 1 and the lifting of the valves 9 is therefore determined by the low speed cam 21.

When the engine operation changes to a high speed mode, the pressure which is supplied to the hydraulic chamber 37 is increased to a level whereat return spring 38 is overcome and the plungers are induced to assume the positions shown in FIG. 4. This locks the main and sub-rocker arms 1, 2 in a manner wherein the larger pivotal motion which is induced in sub-rocker arm 2 by the high speed cam 22, is superimposed on the main one 1 and the valve 9 are subject to lifting control by the high speed cam 22.

When the engine speed lowers to a low speed zone, the pressure in the hydraulic chamber 37 is reduced and the return spring 37 returns the three plungers to the positions shown in FIG. 4. This of course unlocks the main and sub-rocker arms and permits the valve lifting to be controlled by low speed cam 21.

During the periods when the main and sub-rocker arms are interlocked, the high speed cam follower 23 is held out of contact with the base circle 22*b* of the high speed cam while the low speed cam follower (roller 14) alone engages the base circle 22*b* of the low speed cam 22 (viz., during interlock the above mentioned clearance ∂ is established between the high speed cam follower 23 and the base circle 22*b* of the high speed cam 22). As a result, exactly the same lash adjuster settings can be used during both high and low speed modes of operation and no change in the same is induced in response to changes from high speed to low speed modes of engine operation. This of course eliminates the problem encountered with the prior art wherein there is a possibility that a valve or valve will be prevented from fully closing for short periods of time.

On the other hand, should the situation wherein the high speed cam follower 23 be such as to project above the roller 14 when the main and sub-rocker arms are interlocked, then upon change from one mode to another, the length of the lash adjuster 10 will tend to elongate during low speed operation beyond that required for high speed operation, and induce the above mentioned problem upon a low-high speed mode change.

SECOND EMBODIMENT

Figure 6:
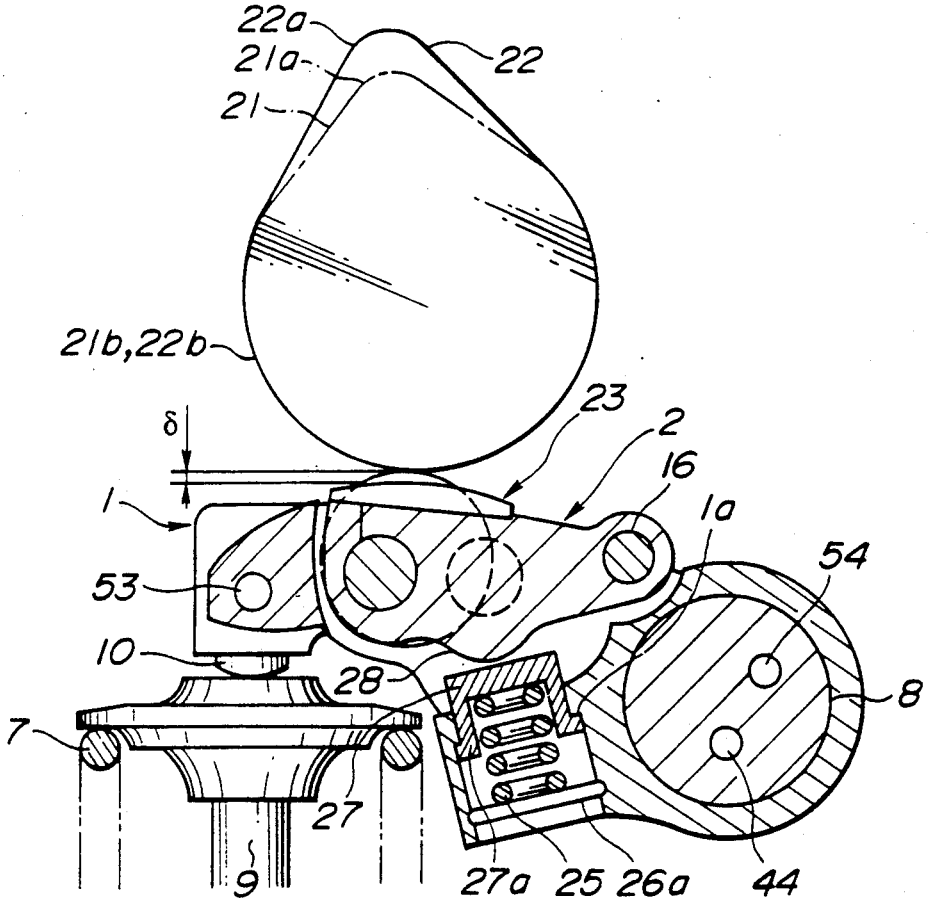
FIG. 6 is a side sectional view showing a second embodiment of the present invention.

FIG. 6 shows a second embodiment of the present invention. In this embodiment the bore in which the retainer 27 is disposed, is formed with a step which acts as a stopper which is arranged to abut a radially extending flange 27*a* formed about the lower edge of the retainer. This arrangement is constructed so that amount by which the sub-rocker arm 2 can be pivotally displaced upward toward the cam shaft, is limited and controlled to a level which tends to bring the bores 32, 35, 36 of the interlocking device into alignment. As will be appreciated, this arrangement improves the smoothness with which the plungers 31, 33 and 34 can move into the adjacent bores and back again, in response to the pressure in the control chamber 37 being raised and lowered to the appropriate levels.

Further merits derived with the instant embodiments are such that, as the sub-rocker arm 2 (high speed rocker arm) is pivotally supported on the main rocker arm 1 (low speed rocker arm) per se by way of the sub-rocker shaft 16 it is possible to greatly reduce the size and mass of the same. As a result, the mass of the sub-rocker arm is lower than that of the prior art discussed in the opening paragraphs of the instant disclosure. This enables the mass of the valve train to be reduced. Further, during high speed modes of operation when the two rocker arms are locked together so as to move as a single unit, as the mass of each unit is reduced as compared with said prior art the valve following characteristics are improved.

On the other hand, during low speed modes of engine operation even though the mass of the sub-rocker arm 2 increases the oscillating mass of the main rocker arm 1, as the speed at which the valves are opened and closed is relatively low, there is no detrimental effect on the valve following characteristics.

In addition to the above, as the sub-rocker is relatively small and light, the lost motion spring can be relatively small and weak. This reduces the amount of friction which is produced between the high speed cam 22 and the follower 23 and thus reduces engine fuel consumption.

Further, as the sub-rocker arm 2 is pivotally mounted on the main rocker arm 1 by way of sub-rocker shaft 16, it is possible to assembly the same to form a unit which can be then mounted on the rocker shaft. The precision with which the roller 14 and follower 23 are mounted on the respective rocker arms can be checked before the unit is actually mounted on the cylinder head. This reduces the amount of work which must be done in order to ensure uniform lift characteristics from cylinder to cylinder.

The fact that the lost motion spring 25 does not require a seat to be formed on the cylinder head per se, reduces the amount of variation during assembly.

In addition, as the plungers 31, 33 and 34 and the return spring 38 can be assembled as a unit, the amount of time required for assembling valve train on the cylinder head is reduced.

What is claimed is:

1. In an internal combustion engine having a cylinder head a first rocker arm pivotally mounted on the cylinder head;

a second rocker arm pivotally mounted on said first rocker arm;

hydraulically operated engagement means for selectively connecting said first and second rocker arms in a manner wherein relative movement therebetween is prevented;

a first cam follower on said first rocker arm, said first cam follower being arranged to operatively engage a first cam which has a base circle portion and a profile portion, the profile portion being suited for low speed engine operation;

a second cam follower on said second rocker arm, said second cam follower being arranged to operatively engage a second cam which has a base circle portion and a profile portion which is suited for high speed engine operation; and wherein said first cam follower and the base circle portion of said first cam are so constructed and arranged that when said hydraulic operated engagement means connects said first and second rocker arms in a manner which prevents relative movement therebetween, a predetermined clearance is established between the base circle portion of said second cam and said second cam follower while the first cam follower is in engagement with the base circle portion of said first cam.

2. An internal combustion engine as claimed in claim 1 further comprising: a hydraulic lash adjuster operatively mounted on said first rocker, said hydraulic lash adjuster being arranged to engage a stem of the poppet valve.

3. An internal combustion engine as claimed in claim 1 wherein the first and second cams are on a single cam shaft and the base circles of said first and second cams have the same diameter, and wherein said first cam follower is arranged to project above said second cam follower when said first and second rocker arms are interlocked by said hydraulic operated engagement means, so that said first cam follower engages the base circle of said first cam and the predetermined clearance is established.

4. An internal combustion engine as claimed in claim 1 further comprising: a lost motion spring mounted on said first rocker arm and arranged to engage said second rocker arm in a manner which biases said second rocker arm against said second cam.

5. An internal combustion engine as claimed in claim 4 wherein said hydraulically operated engagement means comprises:

a first bore formed in said first rocker arm;

a first plunger reciprocatively disposed in said first bore in a manner to define a hydraulic chamber which is in fluid communication with said second passage;

a second bore formed in said second rocker arm, said second bore being formed in said second rocker arm so as to be alignable with said first bore;

a second plunger reciprocatively disposed in said second bore, said second plunger having first end which is abutable with an end of said first plunger, said second plunger having a length which is essentially the same as the length of the bore;

a third bore formed in said first rocker arm, said third bore being formed so as to be alignable with said second bore;

a third plunger reciprocatively disposed in said third bore, said third plunger having a first end which is abutable with a second end of said second plunger; and a return spring disposed in said third bore and arranged to produce a bias which acts on a second end of said plunger.

6. An internal combustion engine as claimed in claim 5 wherein said first, second and third plungers are formed with tapered portions which facilitate the engagement of the first and second rocker arms when the first, second and third bores in which the first, second and third plungers are respectively disposed, are slightly misaligned.

7. An internal combustion engine as claimed in claim 5 further comprising: a retainer which is disposed between said lost motion spring and second rocker arm, said retainer and said first rocker arm being so constructed and arranged that the movement of said retainer toward said second rocker arm is limited and is selected to facilitate the alignment of said first, second and third bores.

8. A valve train as claimed in claim 5 further comprising passage means defined in said first rocker arm and the rocker shaft on which said first rocker arm is pivotally mounted, said passage means being arranged to supply control pressure to said hydraulic chamber.

9. In a gear train for an internal combustion engine a cam shaft operatively mounted on a cylinder head;

a first rocker arm pivotally mounted on the cylinder head;

a second rocker arm pivotally mounted on said first rocker arm;

hydraulically operated engagement means for selectively connecting said first and second rocker arms in a manner wherein relative movement therebetween is prevented;

a first cam follower on said first rocker arm, said first cam follower being arranged to operatively engage a first cam which has a base circle portion and a profile portion, the profile portion being suited for low speed engine operation;

a second cam follower on said second rocker arm, said second cam follower being arranged to operatively engage a second cam which has a base circle portion and a profile portion which is suited for high speed engine operation; and wherein said first cam follower is arranged to project further toward said cam shaft than said second cam follower when said hydraulic operated engagement means connects said first and second rocker arms in a manner which prevents relative movement therebetween.

10. An internal combustion engine as claimed in claim 9 wherein said first cam follower is a roller which is rotatably supported on said first rocker arm.

* * * * *